United States Patent [19]

George

[11] Patent Number: 4,825,574

[45] Date of Patent: May 2, 1989

[54] MOUNTING AND DISPLAY MEDIUM FOR A VISUAL DISPLAY

[75] Inventor: Sherman L. George, Plano, Tex.

[73] Assignee: Metroplex Action, Inc., Dallas, Tex.

[21] Appl. No.: 694,051

[22] Filed: Jan. 23, 1985

Related U.S. Application Data

[63] Continuation-in-part of Ser. No. 479,844, Mar. 28, 1983, abandoned.

[51] Int. Cl.[4] ..... A47G 1/06; G09F 1/10

[52] U.S. Cl. ..... 40/158.1; 40/152.1

[58] Field of Search ..... 40/158 R, 152, 156, 40/152.1

[56] References Cited

U.S. PATENT DOCUMENTS

| | | | |
|---|---|---|---|
| 1,943,022 | 1/1934 | Koster | 40/158 R |
| 3,545,115 | 12/1970 | Nichols | 40/152.1 |
| 4,057,923 | 11/1977 | Chase | 40/158 R |
| 4,079,881 | 3/1978 | Sabb | 40/158 R |
| 4,167,241 | 9/1979 | Zumbrunn | 40/152.1 |
| 4,237,633 | 12/1980 | Murrell | 40/158 R |

*Primary Examiner*—Gene Mancene
*Assistant Examiner*—J. Hakomaki
*Attorney, Agent, or Firm*—Kanz, Scherback & Timmons

[57] ABSTRACT

Disclosed is a mounting and display medium comprising a foldable support base with a pressure-sensitive adhesive on one major face thereof and a release material covering the adhesive. A window is defined in one section of the support base by a continuous cut in the base support medium. The window is formed by removing the release material from said one face of one section of the base support and the visual display placed with its face exposed through the window. The support base is then folded to secure the visual display between the opposed folded sections of the support base.

6 Claims, 3 Drawing Sheets

MOUNTING AND DISPLAY MEDIUM FOR A VISUAL DISPLAY

This invention relates to support, mounting and display media for visual displays such as photographs and the like. More particularly, it relates to a pre-cut support medium foldable to form a permanent display mounting for photographs and the like suitable for transmission through the mails.

Postcards have long been used to transmit brief messages through the mails. Items known as picture postcards are frequently used by travelers and the like to transmit brief messages in connection with places or things associated with their travels. Customarily, such picture postcards display visual graphics such as a photograph or the like integrally formed on one major face thereof with space provided on the opposite face of the card for the name and address of the addressee, postage and a brief message from the sender. While picture postcards are a popular means of transmitting brief information, commercial versions thereof are obviously limited to graphics which have mass appeal. With the advent of self-developing photographic film and rapid commercial film processing, many people would prefer to send postcards of a more personal nature including on one face thereof a photograph taken by the sender. This may be accomplished, of course, by simply affixing the photograph to one face of standard postcard and sending the postcard through the mails. However, this technique is messy and cumbersome since postcards are not ordinarily well adapted for applying adhesives to a surface thereof, adhesives may not be readily available, and many adhesives adversely affect the chemicals used to reproduce the photographic image, thus destroying the quality of the photographic print. Furthermore, the physical size of the postcard and photograph may not match, thereby producing a product which must be trimmed and which does not have the pleasing aesthetic appearance of a professional commercial picture postcard. It is desirable, therefore, to provide a mounting and display medium which can accommodate various sizes of photographs and which can be used to mount the photograph thereon with a minimum amount of effort while producing a pleasing professional-appearing finished product. The mounting medium, however, must not inherently adversely affect any properties of the photograph which would diminish its normal archival characteristics.

In accordance with the present invention, a photograph mounting, display and support medium is provided which is wholly self-contained and foldable to enclose therein photographs (or other visual displays) of various sizes, and which is also suitable for sending through the mails. The mounting means comprises a foldable support medium with a pressure-sensitive adhesive on one major face thereof and a pre-cut window formed in one section thereof to define a matting or frame for surrounding the visual display. The adhesive is covered with a release material which may be simply removed by the user immediately prior to use. The support medium is pre-cut to define a matting frame outlining the photograph and securing the photograph within the folded structure. The adhesive exposed on the face of the matting or frame surface which contacts the front face edges of the visual display is the only adhesive which contacts the photograph. Thus if any adverse reaction occurs between the photograph and the adhesive, the affected portion of the photograph is totally covered by the matting or frame. The finished product is an aesthetically pleasing professional-appearing unitary body displaying the photograph on one major surface thereof with space for postage, name and address of the addressee, and a short message provided on the opposite major face. The entire mounting substrate may be pre-formed and pre-cut ready for use so that additional trimming, gluing or the like is unnecessary. The product may be used as desired to form a personalized picture postcard within seconds. Since no adhesive is applied to the back side of the photograph, the archival longevity of the photograph is unaffected.

Other features and advantages of the invention will become readily apparent from the following detailed description taken in connection with the appended claims and attached drawings in which:

The following disclosure is offered for public dissemination in return for grant of a patent. Although it is sufficiently detailed to provide full understanding of the principles of the invention, this disclosure is not intended to prejudice the purpose of a patent which is to protect each new inventive concept therein no matter how others may later disguise it by variations in form, additions or further improvements.

For convenience and clarity of illustration, the invention is described herein with particular reference to mounting and displaying a photograph in a medium suitable for passing through the mails. It will be appreciated, however, that the invention is not so limited. Instead, the term "photograph" as used herein is intended to encompass and include any visual display whether formed by photographic, xerographic or other reproduction techniques, and also includes original graphic works consisting of text or other visually displayed information.

Figure 1:
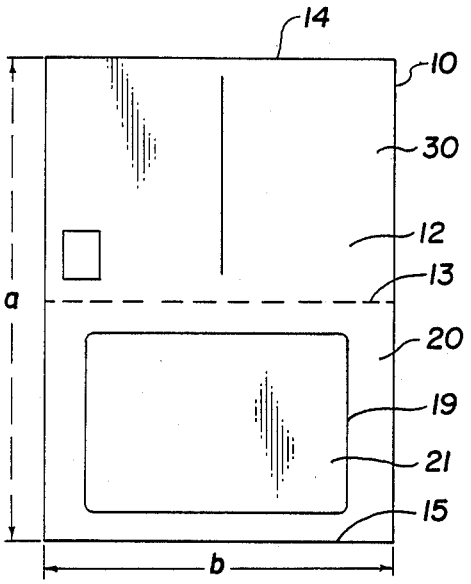
FIG. 1 is a top plan view of the preferred embodiment of the invention.

Referring now to the drawings, the preferred embodiment of the invention and the method of fabricating a personalized postcard are illustrated. As illustrated in FIG. 1, the mounting and display means of the invention includes a substantially flat rectangular foldable support base 10. Support base 10 may be any suitable material such as paper card stock or the like. Since the support base 10 will be folded as explained hereinafter, the longer dimension 'a' as shown in FIG. 1 should be twice the height of the desired finished postcard. Since postcards are usually of standard dimensions such as approximately four inches by six inches, for purposes of discussion dimension 'a' as shown in FIG. 1 should be about eight inches and dimension 'b' should be about six inches. Support base 10 is therefore essentially rectangular and has a first major face 11 (not shown in FIG. 1) and a second opposite major face 12. To aid in folding the support base 10 evenly to produce a finished product, a crease line 13 is preferably formed parallel to and equidistant from opposite end edges 14 and 15 of the support base 10. The second major face 12 is thus divided into a front face section 20 and a back face section 30. Back face section 30 may contain suitable pre printed graphics to indicate the proper place for placement of postage, name and address of addressee, and space for a short written message as in conventional picture postcards.

The first major face 11 (the face opposite that illustrated in FIG. 1) has a pressure-sensitive adhesive (shown at 16 in FIGS. 3 and 4) affixed thereto and a sheet of release material 17 is positioned over the adhesive 16. A cut 18 extends through the release material 17 coincident with the crease 13.

At lease one continuous cut 19 is formed in the front face section 20 of the support base 10. Continuous cut 19 is wholly within the boundaries of the front face section 20 as defined by the lateral edges of support base 10, edge 15 and crease line 13, and defines a removeable panel 21. Since cut 19 defines a removeable panel 21 wholly within the front face section 20, the remaining portion of front face section 20 comprises a matting frame **20*a* surrounding a window 22**.

Figure 2:
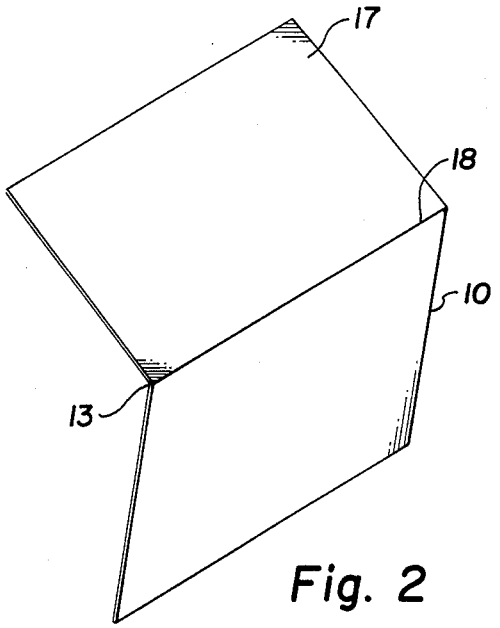
FIGS. 2 and 3 are perspective views of the embodiment of FIG. 1 illustrating the method of removing the release material and forming the window to provide the framing structure of the invention.
Figure 3:
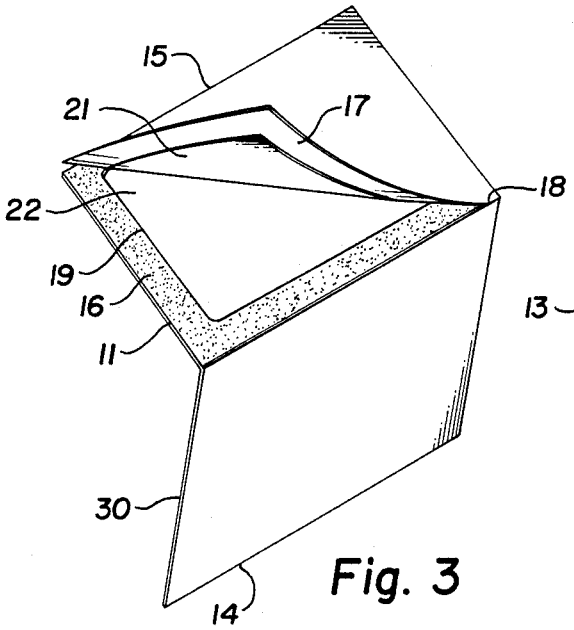
Figure 4:
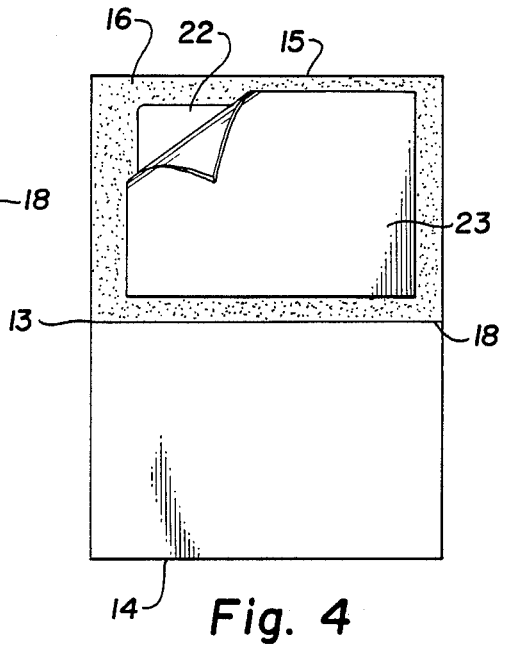
FIG. 4 illustrates the placement of the photograph with respect to the window.
Figure 5:
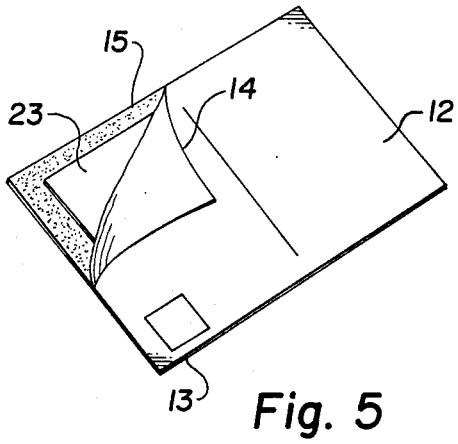
FIG. 5 illustrates the final sequence of steps in forming the finished photograph mounting postcard.
Figure 6:
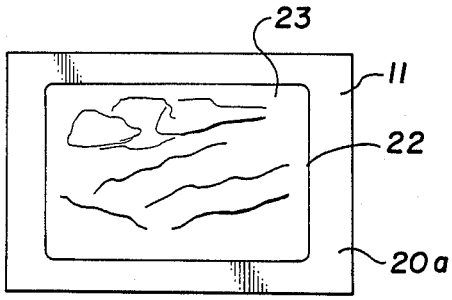
FIG. 6 illustrates the opposite side of the personalized postcard produced in accordance with the invention.
Figure 7:
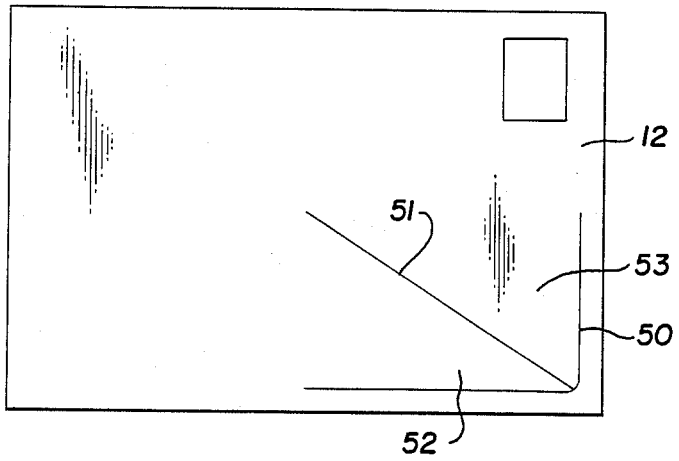
FIG. 7 is a plan view of the back face section (addressee side) of a finished photograph mounting postcard showing the cut configuration which permits forming of an integral easel-back to support the finished product in an erect display position.

To utilize the structure illustrated for mounting and mailing a photograph, the support base 10 is first folded in the direction away from the first major face along crease line 13 and cut 18. By slightly folding the support base 10 along the crease line 13, the edges of the release material 17 are separated at cut 18 so that release material 17 may be peeled from the first major face 11 of the support base 10 opposite front face section 20. As illustrated in FIG. 3, when release material 17 is peeled from adhesive 16, the panel 21 separates from the base support 10 along continuous cut 19 to form a window. The window 22 is, of course, surrounded by matting frame **20*a* which carries exposed adhesive 16 on the back side thereof. The release material 17 is fully removed from the back side of section 20. However, panel 21 remains attached to the release material 17 and thus panel 21 is removed and discarded along with release material 17. The photograph 23 or other suitable flat object to be mounted and displayed is placed with its display face exposed through window 22 so that the front face edges of the photograph contact adhesive 16 as illustrated in FIG. 4. Since the adhesive 16 is pressure sensitive, placing the photograph 23 against the adhesive and applying pressure thereto secures the photograph to the matting frame 20*a*. The base support 10 is then folded along crease line 13 in the opposite direction from that illustrated in FIG. 2 (as illustrated in FIG. 5) so that the first major face 11 of section 20 is folded adjacent the back side of the photograph and the first major face of section 30 and edge 14 coincides with edge 15. The pressure-sensitive adhesive 16 on the frame 20*a* surrounding the edges of the photograph 23 secures the two faces together to produce a unitary body with the face of the photograph 23 exposed through window 22 as illustrated in FIG. 4. The photograph 23 thus is permanently secured within the folded support medium by the adhesive and the two section faces of support medium are secured together to maintain the photograph 23 therebetween. However, the face of the photograph 23 is exposed through window 22 with a border of desired width surrounding same. The opposite side of FIG. 6 (illustrated as back face section 30 in FIG. 1**) may contain suitable graphics to indicate a place for postage, name and address of addressee, and have room for a short written message or the like as in conventional postcards.

It will be appreciated that the outer dimensions of the matting border or frame **20*a* should be greater than the outer dimensions of the photograph so that the edges of the frame 20*a* carrying the adhesive 16 may mate with the face of section 30 and secure the two sections together with the photograph 23 secured therebetween. If necessary, the edges of the photograph may be suitably trimmed. It should be noted that the only adhesive 16 exposed is that on the back face of the frame 20*a* which surrounds the photograph. Thus adhesive is applied only to the front face of the photograph but only at the periphery thereof which is concealed by the frame 20*a***.

It has been discovered that many adhesives, particularly petroleum-based or water-based adhesives (as well as other foreign materials either accidentally or intentionally applied to the back side of a photograph) tend to be eventually absorbed by the paper on which the photographic image is formed. This usually results in a discoloration of the photographic image in the affected area. It is thus important to avoid applying any foreign materials to the back side of a photograph where the quality or archivability of the photograph is in question. Note that in the arrangement discussed above, adhesive 16 is applied only to the periphery of the photograph. However, the adhesive is applied to the entire periphery so that the photograph is securely held by the mat or frame **20*a*. Since the frame 20*a* is larger than the photograph but matches the outline of section 30, the photograph is securely held between the frame 20*a* and the release material 17 covering the back side of section 30. The photograph is thus permanently and securely mounted within the mounting and display device of the invention with the back face of the photograph fully protected from any adhesive or other foreign materials by the release material covering the adjacent face of section 30**.

If the photograph 23 is sufficiently large enough to cover substantially all of the exposed adhesive 16 on the back side of the frame **20*a* and the adhesive will not affect the archival properties of the photograph (such as where the photograph is a visual display formed by other than conventional photographic techniques), the release material covering the back side of section 30 may be removed to expose the adhesive 16 thereon prior to folding the sections together. In this case, the entire back side of the photograph 23 will be secured to the inside surface of back face section 30, thus securely bonding the folded sections together. In this case care should be taken to ensure that the adhesive will not penetrate the back of the photograph. However, since the adhesive 16 covers the entire opposing face of section 30**, the entire back side of the photograph will be uniformly affected. Thus any effect the adhesive may have on the visual image will be uniform throughout the image and normally be unnoticeable. Therefore, the adhesive may not adversely affect archiveablility of the mounted photograph.

It will be realized that the cut 19 defining the window 22 may be encircled by another continuous cut (not shown) to permit the alternative choice of two or more widths for frame **20*a* and two or more sizes or shapes of window 22. In this case the panel 21 coinciding with the desired window would be removed when the release material is removed. To aid in selectively removing only the desired panel, cut 19 (and/or such concentric cuts) may be a line of closely spaced perforations or discontinuous cuts so that the appropriate panel may be removed as desired. It should also be recognized that the crease line 13 need not be parallel with the top and bottom edges of the base support 20. Alternatively, a finished product of the same dimensions as discussed above may be produced using a base support 10 four inches by twelve inches with the crease line 13 separating the base support into two four inch by six inch sections. In this case the base support 10** would be folded side-to-side rather top-to-bottom.

Figure 8:
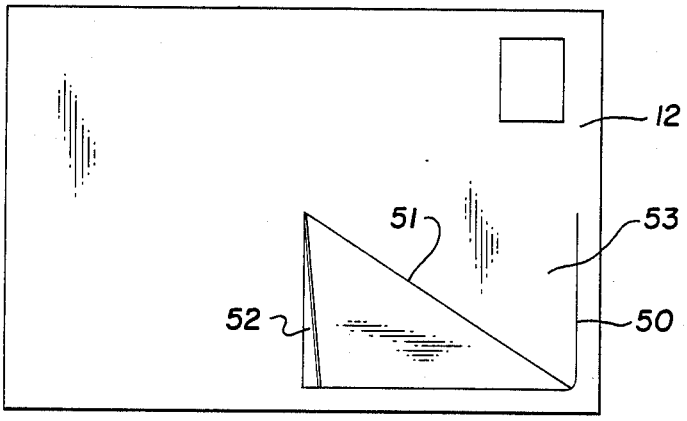
FIG. 8 is a view of the face shown in FIG. 7 illustrating use of one of the easel-back flaps.

Since the photograph 23 is permanently secured within the mounting and display means of the invention, the mounting and display support may also be pre-cut to provide an integral easel for standing the mounted photograph in a display position and/or for adhesively securing the entire assembly on a wall, an album page or other surface for display. This may be accomplished in the manufacture of the support base by forming an L-shaped cut 50 with one leg of the L substantially parallel to a vertical edge and the other leg of the L substantially parallel to the edge which coincides with the bottom of the photograph as shown in FIGS. 8 and 9. The L-shaped cut is preferably formed only in the support base 10 at the same time that crease line 13 and cut 19 are formed therein, but cut 50 is formed in back face section 30. At the same time cut 50 is formed a diagonal cut 51 is also formed extending from the intersection of the legs of cut 50 to approximately the center of section 30, thus defining two tabs 52 and 53. Since cuts 50 and 51 extend only through the support base and not through the release material 17, either tab 52 or tab 53 may be pulled from the release material to form a support easel extending from the back side of the assembly. By pulling either tab outwardly and folding along the edge thereof which remains attached to section 30, an easel-back is formed which will support the entire assembly on one edge for easy viewing. Alternately, one or both of tabs 52 or 53 may be folded 180°, thus exposing the pressure-sensitive adhesive on the back sides thereof. With the adhesive exposed, the back side of the entire assembly may then be affixed to a wall, album page or the like to secure the assembly in position for viewing.

It should be noted that even with the flaps 52 and 53 folded out (either 90° or 180°) release material remains in place on the back side of the photograph, thus fully protecting the photograph 23. The assembly thus provides a permanent mounting and display medium for the photograph which may be transmitted through the mails and in which the photograph remains sealed and fully protected after receipt by the addressee. If desired, however, the support medium may be removed from the photograph without destroying the photograph. The support medium, however, will be essentially destroyed. Note, however, that since the adhesive on the support medium only contacts the front periphery of the photograph, no other portion of the photograph will be affected.

From the foregoing it will be observed that the principles of the invention may practiced and embodied in various forms to provide efficient, simple, inexpensive and effective means for mounting and displaying a visual display. It is to be understood, therefore, that while the invention has been described with particular reference to specific embodiments thereof, the forms of the invention shown and described in detail are to be taken as preferred embodiments of same. Various changes and modifications may be resorted to without departing from the spirit and scope of the invention as defined by the appended claims.

What is claimed:

1. Mounting and display medium for a photograph comprising:

(a) a substantially flat rectangular foldable support base having a first major face and a second opposite major face;

(b) a single continuous crease line extending the full width of said flat support base and formed in said flat support base substantially parallel with and equidistant from two parallel edges of said support base defining a first section on one side of said crease line and a second section on the opposite side of said crease line, said first and second sections being of substantially equal dimensions;

(c) pressure-sensitive adhesive secured to substantially the entire surface of said first major face;

(d) release material covering said adhesive;

(e) a cut extending transversely across said first face coincident with said crease line and dividing said release material into two separable parts; and (f) at least one continuous cut in said first section of said support base wholly within the boundaries defined by said crease line and the edges of said first section defining a window in said first section of said support base whereby said release material covering the first major face of said first section may be removed simultaneously with the portion of said support base within the area defined by said one continuous cut to form a frame having outer dimensions coinciding with the outer dimensions of said second section and inner dimensions defining a window through which said photograph may be viewed, said frame having a continuous coating of pressure-sensitive adhesive on substantially the entire surface of one face thereof and positioned to engage the front face of said photograph only adjacent the periphery thereof concealed by said frame while securing said photograph and said frame to the release material covering said first major face of said second section.

2. Mounting and display medium as defined in claim 1 including graphics displayed on the second major face of said second section indicating a space for postage and space for a brief message.

3. Mounting and display medium as defined in claim 1 wherein, said at least one continuous cut extends only through said support base and not through said release material.

4. Mounting and display medium as defined in claim 1 including a second continuous cut in said first section of said support base wholly within the boundaries defined by said crease line and the edges of said first section surrounding said first continuous cut.

5. Mounting and display medium as defined in claim 1 wherein said continuous cut is a line of closely spaced perforations.

6. Mounting and display medium as defined in claim 1 including cuts in said second section of said base support defining at least one tab foldable outwardly from said second section to provide an easel-back support for said mounting and display means.

* * * * *